US005406296A

United States Patent [19]

Egashira et al.

[11] Patent Number: 5,406,296

[45] Date of Patent: Apr. 11, 1995

[54] THREE-WAVE ANTENNA FOR VEHICLES

[75] Inventors: Yoshimi Egashira, Sagamihara; Katsuhiko Yamakawa, Tokyo, both of Japan

[73] Assignee: Harada Kogyo Kabushiki Kaisha, Tokyo, Japan

[21] Appl. No.: 57,615

[22] Filed: May 5, 1993

[30] Foreign Application Priority Data

May 11, 1992 [JP] Japan ..... 4-117648

[51] Int. Cl.[6] ..... H01Q 1/32

[52] U.S. Cl. ..... 343/715; 343/722; 343/749; 343/791

[58] Field of Search ..... 343/790–792, 343/901, 715, 749, 722; H01Q 1/32, 9/30, 9/32, 5/00

[56] References Cited

U.S. PATENT DOCUMENTS

| | | | |
|---|---|---|---|
| 4,509,056 | 4/1985 | Ploussios | 343/792 |
| 4,748,450 | 5/1988 | Hines et al. | 343/791 |
| 5,079,562 | 1/1992 | Yarsunas et al. | 343/792 |
| 5,248,988 | 9/1993 | Makino | 343/790 |

*Primary Examiner*—Michael C. Wimer
*Attorney, Agent, or Firm*—Koda and Androlia

[57] ABSTRACT

A three-wave antenna for vehicles which includes a monopole antenna element which has an electrical length of approximately ¼ of the wavelength in the FM broadcast band along with a double sleeve used to prevent current flow and with a second double sleeve used for phase adjustment that are installed coaxially with the antenna element. The positional relationships between the inner and outer cylinders of each one of the first and second double sleeves relative to the antenna element are respectively specified. In addition, an antenna attachment which has a capacitive reactance and is installed at the base of the antenna element so that it cancels the inductive reactance of the antenna and causes the impedance of the antenna to approach a prescribed value is employed together with a wave splitter which includes a high pass filter that has a double tuning function with respect to the inductive reactance and the capacitive reactance and a low pass filter that separates the AM/FM broadcast band signals from the telephone band.

2 Claims, 5 Drawing Sheets

THREE-WAVE ANTENNA FOR VEHICLES

BACKGROUND OF THE INVENTION

1. Field of the Invention

The present invention relates to a three-wave common antenna for use in vehicles which uses a double sleeve system so as to transmit and/or receive three types of radio waves, that is, AM waves, FM waves, and telephone waves, via a single antenna element.

2. Prior Art

The AM and FM broadcast waves and telephone waves which are transmitted and received by wireless telephones used in automobiles have greatly different frequencies. At present, therefore, an antenna for receiving AM and FM waves and an antenna for transmitting and receiving telephone waves are installed separately at different locations on a vehicle body.

FIGS. 5 (*a*) and 5 (*b*) respectively show a conventional example of an antenna for AM/FM reception and a conventional example of an antenna for telephone transmission and reception.

The AM/FM receiving antenna shown in FIG. 5 (*a*) has an overall length of 790 to 840 mm and uses a tapered rod 1 which has a slender tip end and a thick base end. This antenna is set at a length of roughly $\lambda/4$ so that it can act as a monopole antenna with respect to FM waves. The antenna is also set at a more or less standard length so that the required sensitivity can be obtained with respect to AM waves. If the overall length of the antenna is greater than 790 to 840 mm, the sensitivity with respect to AM waves is improved, but the sensitivity with respect to FM waves drops, especially on the high-frequency side of the FM band. If the overall length of the antenna is less than 790 to 840 mm, the sensitivity with respect to AM waves drops abruptly, and the sensitivity with respect to FM waves also drops, especially on the low-frequency side.

The telephone transmitting and receiving antenna shown in FIG. 5 (*b*) uses a so-called two-stage collinear system. In other words, a phase coil 3 is installed roughly at the middle of the antenna rod 2. The overall length of this antenna is 250 to 300 mm. This telephone antenna has a sensitivity of +3 dB at the standard dipole antenna ratio.

The AM/FM receiving antenna shown in FIG. 5 (*a*) is usually mounted to one of the fenders of a vehicle body, and the telephone antenna shown in FIG. 5 (*b*) is ordinarily attached to the trunk of the vehicle or to the edge of the roof.

However, the separate installation of the two different types of antennas as described above has a deleterious effect on the design of the vehicle. The additional attachment work required is a nuisance, too.

FIG. 5 (*c*) shows one example of a three-wave common antenna which includes an AM/FM receiving antenna combined with a telephone transmitting and receiving antenna. Thus, this antenna is in a single antenna unit to solve the above-described problems. In this antenna, the antenna section is formed as a so-called three-stage collinear system with respect to the telephone waves, and the overall length of the antenna rod 4 is 580 to 630 mm. Two phase coils 5 and 6 are installed at intermediate points of the antenna rod 4, and a wave splitter 7 which is used to separate AM/FM waves from telephone waves is installed on the base of the antenna. Connectors 8 and 9 are installed on branched cable tips and respectively connected to an AM/FM radio receiver and wireless telephone set.

Problems the Present Invention is to Solve

The antenna shown in FIG. 5 (*c*) is a high-gain antenna with respect to telephone waves. However, since this antenna employs a three-stage collinear system, the radiation beam is narrow. In addition, an abrupt sensitivity drop occurs even in a minimal inclination of the antenna. Furthermore, in the antenna of FIG. 5 (*c*), the two phase coils 5 and 6 act as loading coils with respect to FM waves. Accordingly, good VSWR characteristics are obtained, and a sensitivity which is close to that of a $\lambda/4$ monopole antenna is obtained. However, in regard to AM waves, the antenna is shorter than the standard length of 790 to 840 mm shown in FIG. 5 (*a*). Accordingly, as a result of a synergistic effect between the drop in the electrostatic capacitance between the antenna and the fender and the AM-induced voltage which drops more or less proportionally with the antenna length, the sensitivity drops by approximately −3 to −5 dB compared to an antenna with a length of 790 to 840 mm. Furthermore, there are problems from a mechanical standpoint. In particular, stress tends to be concentrated near the lower phase coil 6 due to wind pressure and vibration during operation of the vehicle. Thus, antenna breakage due to metal fatigue or other factors would occur. In addition, the two phase coils 5 and 6 must be precisely formed during the manufacture of the antenna in order to maintain the necessary characteristics. Thus, there are problems in terms of quality variation, too.

SUMMARY OF THE INVENTION

The object of the present invention is to provide a three-wave common antenna for use in vehicles whose sensitivity with respect to AM and FM waves can be maintained at the level of a conventional 790 to 840 mm antenna and whose sensitivity and VSWR characteristics with respect to telephone waves are sufficient enough for practical use.

In order to solve the problems and achieve the object, the means below are adopted in the present invention.

(1) In particular, the antenna of the present invention includes: a monopole antenna element which has an electrical length of about $\lambda f/4$, where $\lambda f$ is the wavelength of FM waves; a first double sleeve which is used to prevent current flow and installed coaxially with the monopole antenna element; and a second double sleeve which is used for phase adjustment and installed coaxially with the monopole antenna element, the second double sleeve being at a prescribed distance toward the base end of the antenna from the first double sleeve.

The distance L1 which is from the tip end of the monopole antenna element to the tip end of the inner pipe of the first double sleeve is set approximately at an odd-numbered multiple of $\lambda m/4$, where $\lambda m$ is the wavelength at the center frequency of the telephone band. The distance L2 which is from the tip end of the inner pipe of the first double sleeve to the tip end of the inner pipe of the second double sleeve is set to be approximately $3\lambda m/4$. The distance L3 which is from the tip end of the inner pipe of the second double sleeve to the vehicle body panel is set to be the length in the inductive reactance region that is longer than $\lambda 1/4$, where $\lambda 1$ is the wavelength at the low frequency end of telephone band. Furthermore, the distance L4 which is from the tip end of the outer pipe of the second double sleeve to the vehicle body panel is set at a length in the inductive reactance region that is longer than λh/4, where λh is the wavelength of the high frequency end at telephone band.

(2) Furthermore, an antenna attachment and a wave splitter are added to the antenna described above. The antenna attachment is located at the base end of the antenna element and has a capacitive reactance. Also, the antenna attachment is installed so that it can cancel the inductive reactance of the antenna and causes the impedance of the antenna to approach a prescribed value. The wave splitter includes a high-pass filter that has a double tuning function with respect to the inductive reactance and capacitive reactance and a low-pass filter that separates the AM/FM waves from the telephone waves.

As a result of the means described above, the present invention provides the following effects: the first and second double sleeves which have no effect on AM or FM waves are added to a conventional antenna element that has a length of 790 to 840 mm and provides sufficient practical results in regard to AM and FM waves. Accordingly, the resulting antenna has a sensitivity equivalent to that of a conventional antenna with respect to AM and FM waves and has a sufficient sensitivity and VSWR characteristics with respect to telephone waves due to the first and second double sleeves.

DETAILED DESCRIPTION OF THE INVENTION

Figure 1:
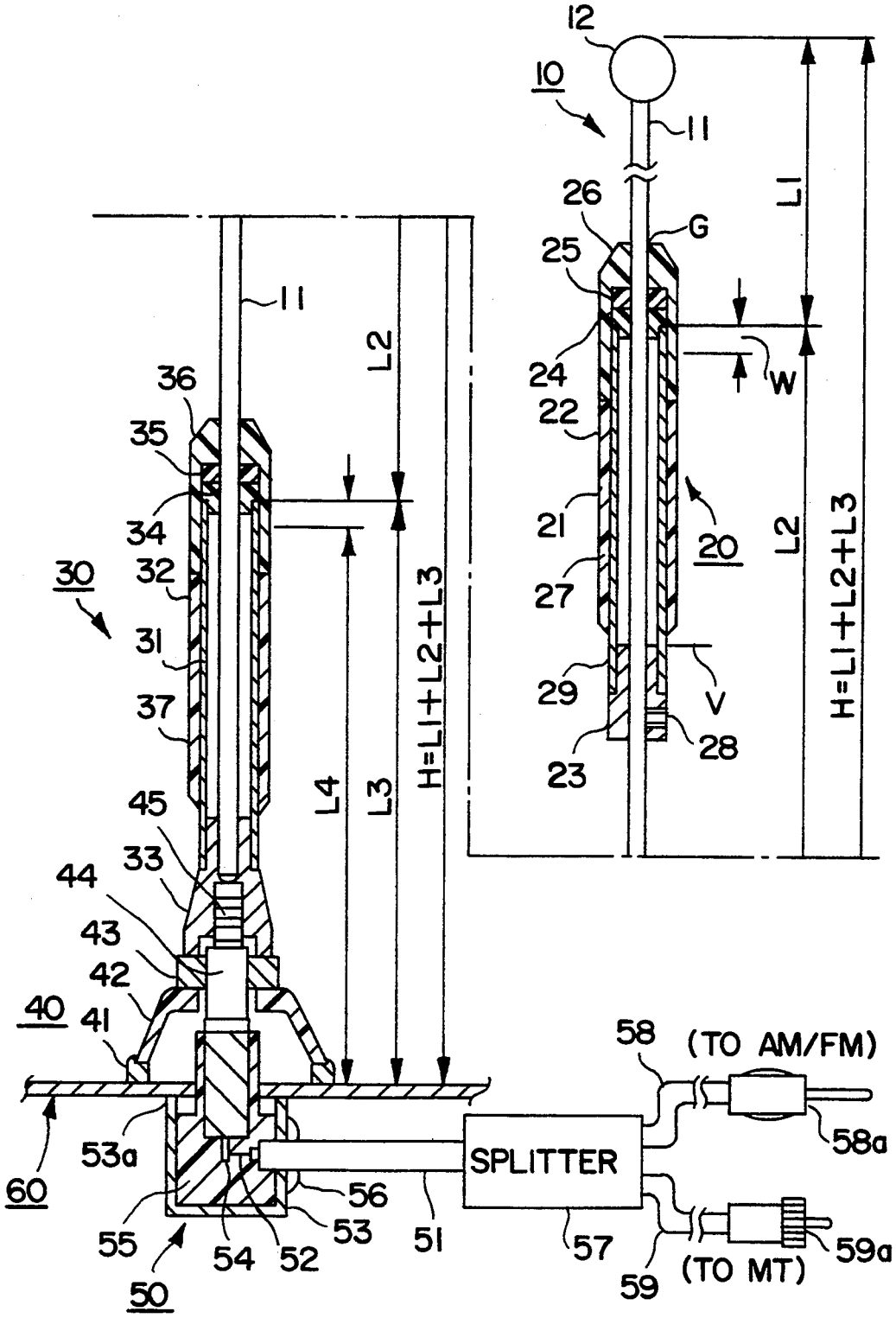
FIG. 1 illustrates the structure of one embodiment of a three-wave antenna for use in vehicles in accordance with the present invention.

FIG. 1 illustrates the structure of one embodiment of the three-wave common antenna for use in vehicles according to the present invention. As shown in FIG. 1, this antenna consists of a monopole antenna element 10, a first double sleeve 20, a second double sleeve 30, an antenna support 40, and a feeder section 50. The antenna support 40 and the feeder section 50 make an antenna attachment in the present invention.

A tapered rod 11 which has shown respectable results in both electrical and mechanical terms is used as the monopole antenna element 10. An ornamental cap 12 is attached to the tip end (or upper end) of this tapered rod. The height H of the antenna element 10, that protrudes upward from vehicle body panel 60, is set at an electrical length of about λf/4, where λf is the wavelength of FM waves.

The first double sleeve 20 is for preventing current flow and is installed coaxially with the monopole antenna element 10. The second double sleeve 30 is for a phase adjustment and is installed coaxially with the monopole antenna element 10. The second double sleeve 30 is provided at a position located at a prescribed distance adjacent the base end of the antenna from the first double sleeve 20.

The first double sleeve 20 is comprised of an inner pipe 21, an outer pipe 22, a joint 23, an insulator 24, a waterproof rubber 25, a cover 26, a dielectric 27 and a fastening thread 28. In electrical terms, the first double sleeve 20 forms a quarter-wavelength resonator, in which the inner pipe 21 and the outer pipe 22 are coaxial with the antenna element 10. Also, joint 23 is made of a conductive material and cover 26 is made from a dielectric. The base end (or bottom end) of the inner pipe 21 is engaged with the external circumference of the joint 23 by pressure fitting or other method. Likewise, the base end (or bottom end) of the outer pipe 22 is engaged with the external circumference of the inner pipe 21 by pressure fitting or other method. These engaged components are fixed to the joint 23 by caulking or other method so that the components are electrically short-circuited.

The length of the inner pipe 21, which is measured relative to the short-circuited surface V, is set to be approximately λ1/4, where λ1 is the wavelength at the low frequency end of telephone band. Thus, a current-blocking effect is obtained with respect to the low frequency end f1 of telephone band. The tip ends (or upper ends) of the inner pipe 21 and outer pipe 22 are open with respect to the tapered rod 11 of the antenna element 10. Thus, a high impedance is created. The open end of the inner pipe 21 is maintained in a coaxial relation with respect to the external circumference of the antenna element 10 by the insulator 24. In order to maintain the outer pipe 22 in a coaxial position with respect to the inner pipe 21 and antenna element 10, a cylindrical cover 26 is used. The cylindrical cover 26 is designed so that its open end enters slightly into a gap between the outer pipe 22 and inner pipe 21. A waterproof rubber 25 is made of, for example, soft rubber and inserted into the inside bottom part of the cylindrical cover 26, thus preventing the entry of moisture through the gap G that is between the cylindrical cover 26 and the external circumferential surface of the tapered rod 11 of the antenna element 10.

The length of the outer pipe 22 is set near λh/4, where λh is the wavelength of the high frequency end at telephone band. Thus, a current-blocking effect is obtained with respect to the high frequency band fh of the telephone waves. In order to reduce the coupling with the antenna element 10 and the open end of the inner pipe 21, the open end of the outer pipe 22 has a step difference W so that the respective distances are increased.

A dielectric 27 which has a predetermined dielectric constant is interposed between the inner pipe 21 and the outer pipe 22. Thus, the length of the outer pipe 22 is shortened so that the effect of the step difference W is insured. It is confirmed that good results can be obtained, with no deleterious effects in terms of overall characteristics, even if air is used as the dielectric 27. The ratio of the external diameter of the rod 11 of the antenna element 10 to the internal diameter of the inner pipe 21 and the ratio of the external diameter of the inner pipe 21 to the internal diameter of the outer pipe 22 should be as large as possible so that the band area of the sleeve can be broadened. In this embodiment, the internal diameter of the outer pipe 22 is 10.5 to 10.6 mm.

The second double sleeve 30 is structurally substantially identical to the first double sleeve 20 and includes insulator 34, water-proof rubber 25 and cover 36. However, the length of the inner pipe 31 of the second double sleeve 30 is set so that it is slightly shorter than λ1/4, where λ1 is the wavelength at the low frequency end of telephone band. Thus, a phase-adjusting effect is obtained with respect to at least the low frequency band f1 of the telephone waves. In other words, while the first double sleeve 20 acts as a current-blocking sleeve, the second double sleeve 30 acts as a phase-adjusting sleeve. The joint 33 has inner threads at the base end that can engage with external threads 45 of a stud bolt 44 of the antenna support 40. A dielectric 37 with a dielectric constant of 2.07 to 2.15 is interposed between the inner pipe 31 and outer pipe 32. Additionally, the joint 33 is made from an electrically conductive material and cover 36 is made of a dielectric. It is confirmed that this produces favorable results.

The distance L1 which is from the tip (or upper) end of the monopole antenna element 10 to the tip (or upper) end of the inner pipe 21 of the first double sleeve 20 is set so as to be approximately an odd-numbered multiple (a multiple of five in this embodiment) of λm/4, where λm is the wavelength at the center frequency of telephone bands. The distance L2 which is from the tip (upper) end of the inner pipe 21 of the first double sleeve 20 to the tip (or upper) end of the inner pipe 31 of the second double sleeve 30 is set so as to be approximately 3λm/4. The distance L3 from the tip (or upper) end of the inner pipe 31 of the second double sleeve 30 to the vehicle body panel 60 is set at a length of the inductive reactance region that is longer than λ1/4, where λ1 is the wavelength at the low frequency end of telephone band. The distance L4 which is from the tip (or upper) end of the outer pipe 32 of the second double sleeve 30 to the vehicle body panel 60 is set at a length of the inductive reactance region that is longer than λh/4, where λh is the wavelength at the high frequency end of the telephone band.

The antenna support 40 comprises a metal attachment nut 43, an insulator 42 and a waterproof element 41 as well as the stud bolt 44. A (lower) portion of the stud bolt 44 is integral with the feeder section 50 described below.

The feeder section 50 comprises a central conductor 52 of a coaxial cable 51, a connecting point 54 of the stud bolt 44, a metal grounding cover 53 which prevents unnecessary radiation from the connecting point 54, and a resin 55 installed in the cover 53. The resin 55 makes the metal grounding cover 53 and the connecting point 54 of the stud bolt 44 into an integral unit. The outer conductor (not shown) of the coaxial cable 51 is connected to the grounding cover 53 via a connecting portion 56. The upper rim 53*a* of the grounding cover 53 is pressed against the vehicle body panel 60 so that grounding is accomplished. Ideally, it is desirable that the stray capacitance between the feeder section 50 and the ground be zero; however, for structural reasons, an electrostatic capacitance of a few pF is unavoidable. Accordingly, the antenna attachment that is made up by the feeder section 50 and the antenna support 40 is deliberately endowed with a capacitive reactance −jx which can cancel the inductive reactance +jx of the antenna and cause the impedance of the antenna to approach a prescribed value (50 ohms).

A wave splitter 57 which includes a high-pass filter and a low-pass filter is connected to the other end of the coaxial cable 51. The high-pass filter has a double tuning function with respect to the inductive reactance and capacitive reactance, and the low-pass filter separates the AM and FM waves from the telephone waves. A coaxial cable 58 having a plug 58*a* for AM/FM waves is connected to one of the branched ends of the wave splitter 57, and a coaxial cable 59 having a plug 59*a* for telephone waves is connected to the other branched end of the wave splitter 57.

Figure 2:
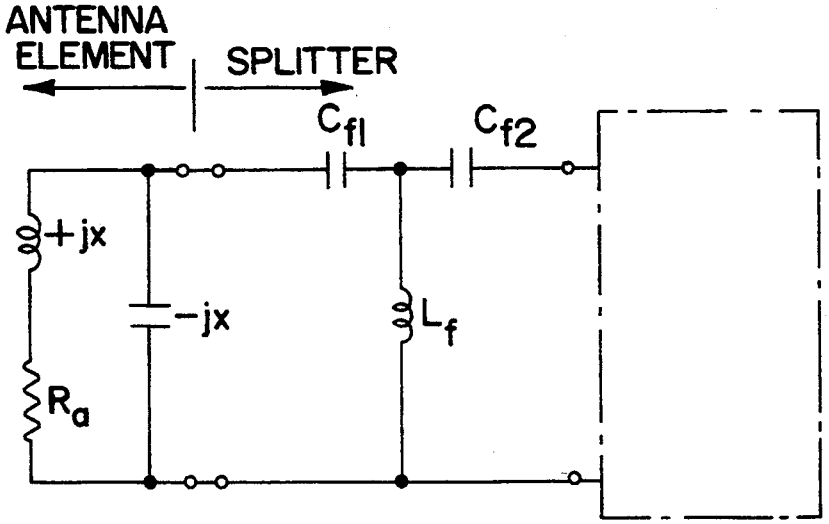
FIG. 2 is an equivalent circuit diagram of the three-wave antenna of the embodiment of FIG. 1.

FIG. 2 is an equivalent circuit diagram of the three-wave common antenna of the present embodiment and comprises effective antenna resistance Ra, antenna inductance +jx, antenna capacitance −jx and bypass filters $C_{f1}$, $C_{f2}$ and $L_f$. The diagram shows that double tuning, which is accomplished by causing the resonance frequency depending on +jx and −jx to be slightly different from the resonance frequency depending on Cf1 and Lf, is obtained with respect to the telephone band, thus accomplishing a broad band.

Figure 3A:
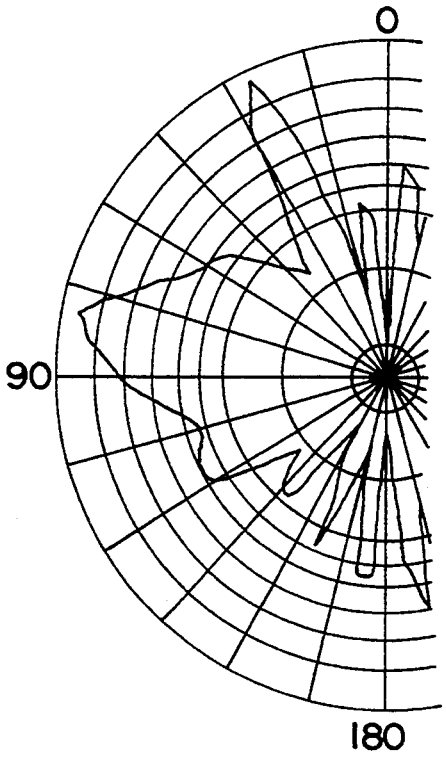
FIGS. 3(*a*), 3(*b*) and 3(*c*) are vertical-plane radiation patterns and VSWR characteristics for the three-wave antenna of the embodiment of FIG. 1.
Figure 3B:
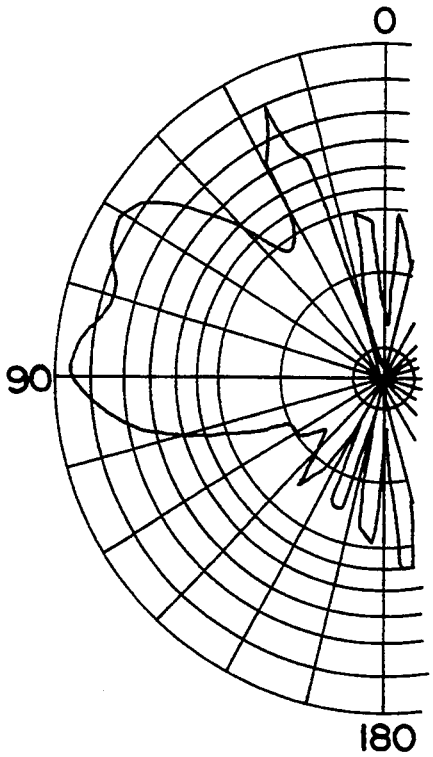
Figure 3C:
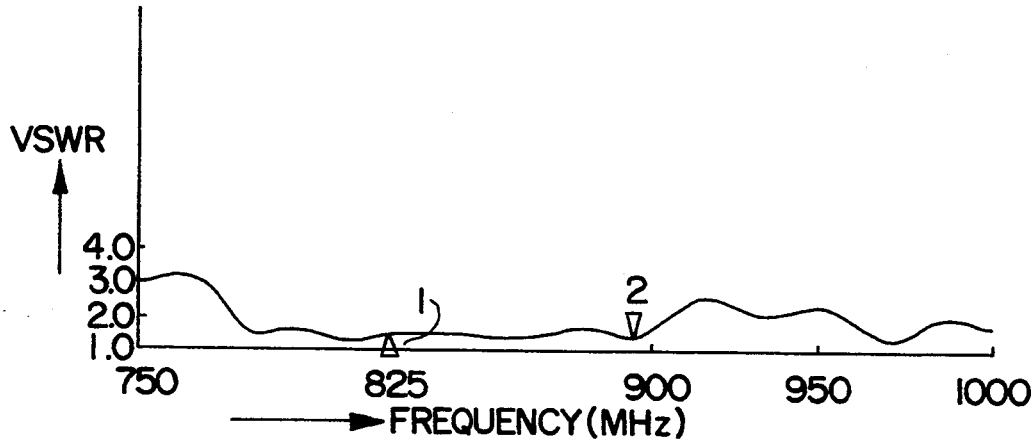

FIGS. 3 (*a*) and 3 (*b*) show the vertical-plane radiation patterns in the low frequency band and high frequency band of the telephone waves. As shown in FIG. 3 (*a*), collinear characteristics are exhibited in the low region (835 MHz). In this case, there is a gain of +0.2 dBd in terms of operating gain or +2.0 dBd in terms of antenna gain. This pattern points in roughly the horizontal direction, and the half-value angle is around 20 degrees. Thus, an ideal value is shown. In the high region (880 MHz), as shown in FIG. 3 (*b*), slightly collinear characteristics are exhibited. However, there is some directionality in the horizontal direction, and the gain in this case is +0.4 dBd in terms of operating gain and +2.2 dBd in terms of antenna gain.

FIG. 3 (*c*) shows the results of the measurement of the VSWR characteristics in the telephone frequency measured at the connecting portion. In FIG. 3 (*c*), the frequency band between the Mark 1 and the Mark 2 (which is 825 to 895 MHz) is the telephone frequency band used in the U.S.A. In the broad band of 780 to 900 MHz which covers this U.S.A. band, the VSWR shows a value of 1.9 or less, which is that the antenna has sufficient broad-band characteristics.

Figure 4A:
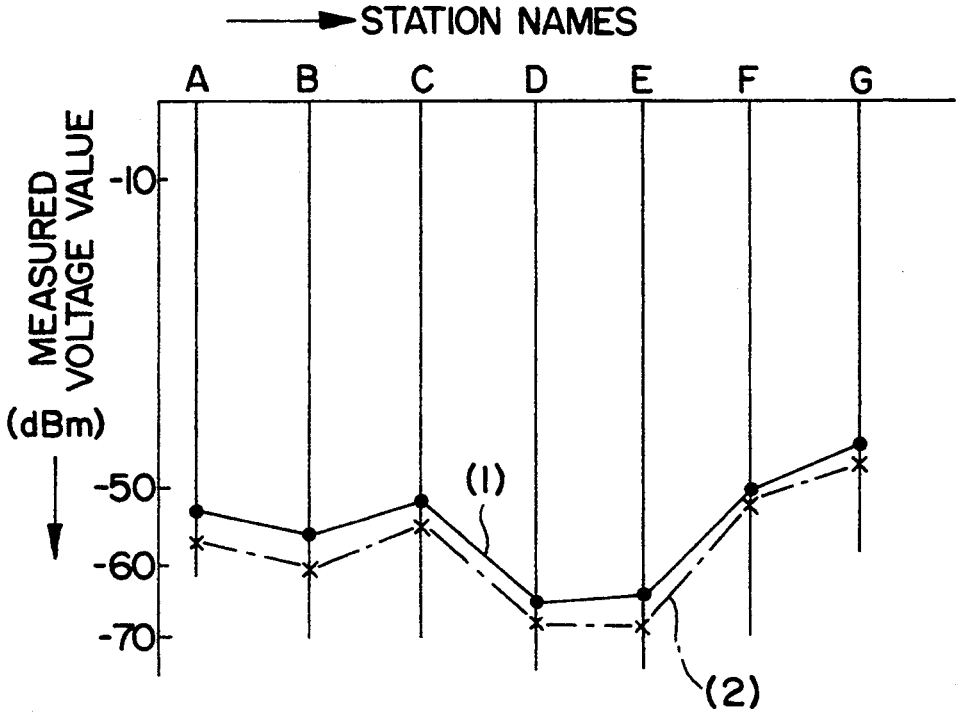
FIGS. 4(*a*) and 4(*b*) are AM sensitivity measurement results and FM sensitivity measurement results for the three-wave antenna of the embodiment of FIG. 1 compared to the results obtained with the conventional antenna.
Figure 4B:
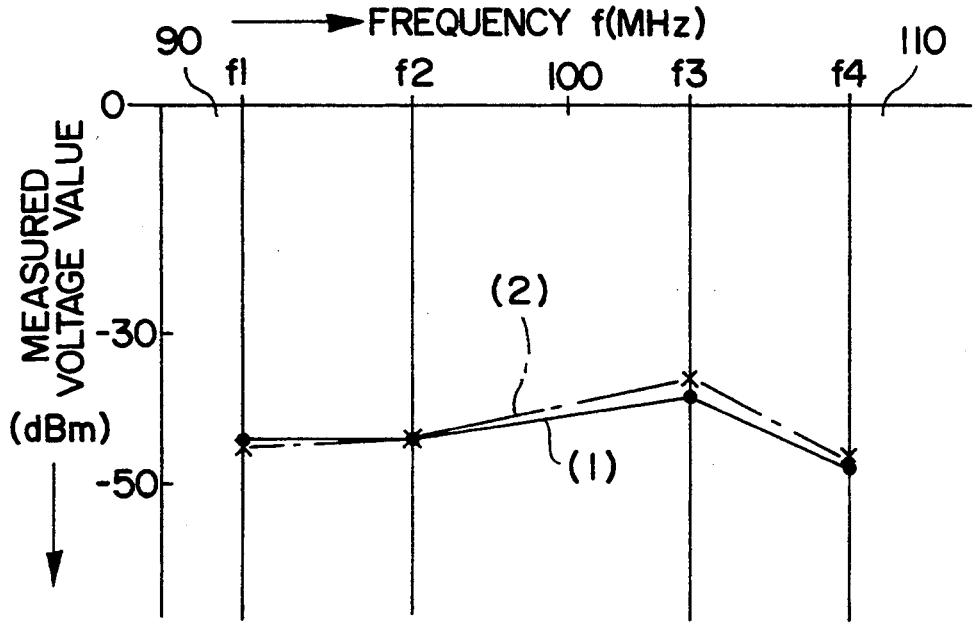
Figure 5A:
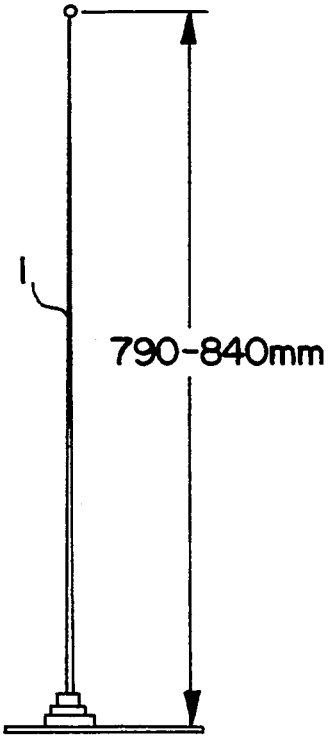
FIG. 5(a) PRIOR ART
FIGS. 5(*a*), 5(*b*) and 5(*c*) are the structures of conventional antennas.
Figure 5B:
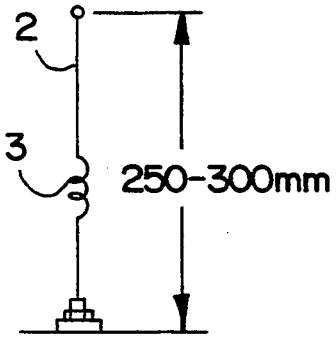
FIG. 5(b) PRIOR ART
Figure 5C:
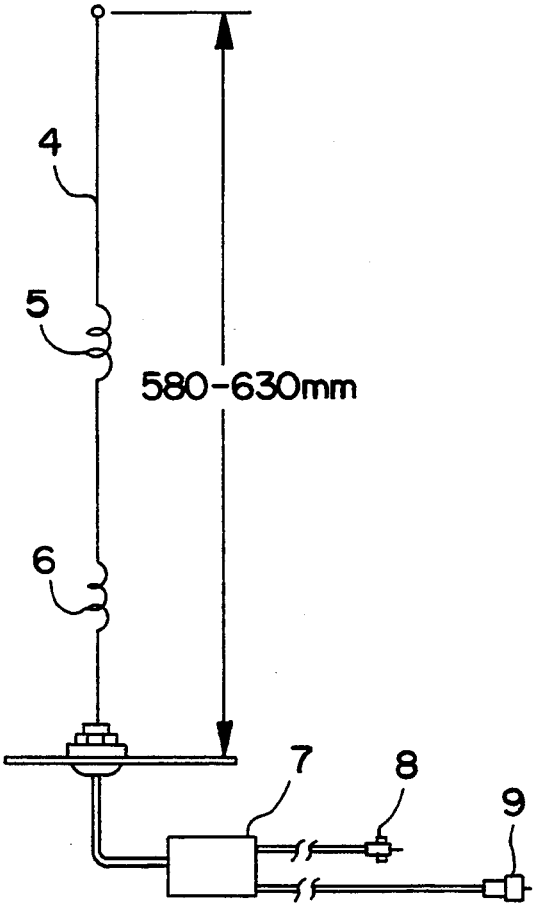
FIG. 5(c) PRIOR ART

FIG. 4 (*a*) shows the measurement results for AM sensitivity, and FIG. 4 (*b*) shows measurement results for FM sensitivity. Both sets of results are shown in comparison to the sensitivity characteristics of the conventional three-wave common antenna shown in FIG. 5 (*c*). In these Figures, the line (1) indicates the results of the present embodiment, and the line (2) indicates the results of the conventional antenna. As seen from FIG. 4 (*a*), the antenna of the present embodiment is superior to the conventional antenna by approximately +3 dB, on the average, in terms of AM sensitivity. From FIG. 4 (*b*), the antenna of the present embodiment appears to be slightly inferior to the conventional antenna in terms of FM sensitivity in the high region; however, this difference is very small and does not cause any obstacle to practical use.

As seen from the above, the three-wave common antenna according to the embodiment can act as a quarter-wavelength monopole antenna with respect to FM waves, as a miniature monopole antenna (similar to conventional types) with respect to AM waves, and as an antenna showing collinear broad-band characteristics with respect to telephone waves.

The present invention is not limited to the embodiment described above. It goes without saying that various modifications are possible within the spirit of the present invention.

According to the present invention, first and second double sleeves are added to a conventional antenna element that has a length of 790 to 840 mm and has been used reliably for AM and FM waves. Accordingly, the three-wave antenna has equal sensitivity to a conventional antenna with respect to AM and FM waves and has the sufficient sensitivity and VSWR characteristics with respect to telephone waves.

What is claimed is:

1. A three-wave antenna for vehicles comprising:

a monopole antenna element which has an electrical length of approximately $\lambda f/4$, where $\lambda f$ is a wavelength in an FM broadcast band;

a first double sleeve which is used to prevent current flow and is provided coaxially with and electrically coupled to said monopole antenna element, said first double sleeve comprising two coaxial, electrically conductive cylinders; and a second double sleeve which is used for phase adjustment and is provided coaxially with and electrically coupled to said monopole antenna element at a position adjacent a base end of said antenna element and a predetermined distance from said first double sleeve; and a distance L1 from a tip end of said monopole antenna element to a tip end of an inner cylinder of said first double sleeve being set to be approximately an odd-numbered multiple of $\lambda m/4$, where $\lambda m$ is a wavelength at a center frequency of a telephone band;

a distance L2 from a tip end or said inner cylinder of said first double sleeve to a tip end of an inner cylinder of said second double sleeve being set to be approximately $3\lambda m/4$;

a distance L3 from said tip end of said inner cylinder or said second double sleeve to a vehicle body panel being set to be a length of inductive reactance that is longer than $\lambda 1/4$, where $\lambda 1$ is a wavelength at a low frequency end of said telephone band; and a distance L4 from a tip end or an outer cylinder of said second double sleeve to said vehicle body panel being set to be a length of inductive reactance that is longer than $\lambda h/4$, where $\lambda h$ is a wavelength at a high frequency end of said telephone band.

2. A three-wave antenna for vehicles according to claim 1, further comprising: an antenna attachment provided at said base end of said antenna element, said antenna attachment having a capacitive reactance and being installed so as to cancel said inductive reactance of said antenna and to cause an impedance of said antenna to approach a prescribed value; and a wave splitter which includes a high-pass filter and a low-pass filter, said high-pass filter having a double tuning function with respect to said inductive reactance and said capacitive reactance, and said low-pass filter separating AM/FM waves from telephone waves.

* * * * *